United States Patent [19]

Nitz

[11] 4,172,347

[45] Oct. 30, 1979

[54] ELECTRONIC PROGRAM CONTROL

[75] Inventor: Walter D. Nitz, West Bloomfield Township, Oakland County, Mich.

[73] Assignee: Ex-Cell-O Corporation, Troy, Mich.

[21] Appl. No.: 902,606

[22] Filed: May 3, 1978

[51] Int. Cl.[2] ..... B65B 57/16

[52] U.S. Cl. ..... 53/52; 53/77; 53/493; 53/505; 198/502

[58] Field of Search ..... 53/52, 77, 493, 505; 198/502

[56] References Cited

U.S. PATENT DOCUMENTS 3,732,664 5/1973 Blossom et al. ..... 53/77 X

*Primary Examiner*—Travis S. McGehee

*Attorney, Agent, or Firm*—John P. Moran; James H. Bower

[57] ABSTRACT

An electronic control system for controlling a sequence of operations on products moving on an indexing conveyor. The electronic control system is illustrated as controlling a sequence of operations, carried out at various work stations, on cartons in a packaging machine, such as filling operations, sealing operations, and clean-in-place operations on carton filler heads. A limit switch carton detector detects the presence or absence of cartons on the indexing conveyor of the packaging machine and feeds such carton information into a first shift register, which in turn feeds the carton position information into a first "and" gate. A limit switch machine timing indicator functions to feed a first machine timing signal into said first shift register, and into a machine cycle counter. An output signal from the machine cycle counter is fed into a sequence selector which products a sequence signal that is fed to said first "and" gate, which in turn produces a filler sequence signal. The carton position information from said first shift register is also fed into a second shift register, and together with a second machine timing signal produced by a second limit switch machine timing indicator, produces a second shift register output carton position signal that is fed into a second "and" gate. The last mentioned second machine timing signal is also fed into an overtime timer which produces an output signal that is also fed into the second "and" gate, and the output from the second "and" gate produces a sonic sequence control signal for controlling the sonic sealer head on the packaging machine. A limit switch machine mechanism position indicator produces a machine mechanism position signal which is fed into a C.I.P. sequence timer which produces an output signal that is fed into the sequence selector to provide an output signal to the first "and" gate which produces a filler sequence control signal when the packaging machine is not running.

10 Claims, 14 Drawing Figures

ELECTRONIC PROGRAM CONTROL

BACKGROUND OF THE INVENTION

1. Field of the Invention

This invention relates generally to the electronic control art, and more particularly, to a novel electronic control system for controlling a sequence of operations on products moving on an indexing conveyor, such as a sequence of operations carried out on containers by a packaging machine.

2. Description of the Prior Art

It is known in the packaging art to provide pneumatic or air control systems for controlling operations carried out at various work stations on cartons in a packaging machine, such as filling operations, sealing operations and so forth. The aforedescribed prior art logic systems are entirely pneumatic systems employing air control valves, and mechanical detectors or levers which control the operation of the apparatuses at the work stations, as for example, the filler apparatus at the filling stations, and the carton sealing apparatus at the sealing station. The mechanical detectors or levers operate the air control valves which in turn operate the filler cylinders of the filler apparatus. In an air logic system, with a four station filler apparatus, there are four mechanical detectors required to operate the four cylinders in such an apparatus. A problem resulting from the use of such mechanical detectors is that they must be located in the immediate filler discharge area, whereby they are subject to spillage and other contaminants which injuriously affect the operation of such mechanical detectors.

A further disadvantage of the prior art logic control systems described above is that each filler cylinder is employed to dispense product into every carton, and under some circumstances, such as smaller capacity cartons, some of the filler cylinders are not operated which results in stagnation of product in the filler valves due to non-use.

Another disadvantage of the prior art filler control apparatus is that the non-use of some filler cylinders as described in the previous paragraph results in non-uniform wear of the filler parts from cylinder to cylinder which results in degradation of calibration uniformity.

The prior art air logic filler control systems also produces an unbalanced mechanical loading on the filler drive mechanism when some of the filler valves are not used for a filling operation. The last mentioned imbalance of mechanical loading causes a non-uniform wear on all of the moving parts of the filler drive mechanism.

Another disadvantage of the aforedescribed prior art air logic filler control systems is that the mechanical detectors or levers employed in such systems must make a large contact area and exert a somewhat large force on each of the cartons as they are moved to a filler station which actions result in damage in certain instances to the cartons.

Still another disadvantage of the prior art filler control systems is that the clean-in-place (C.I.P.) system for cleaning the filler apparatus requires an external mechanical timing device and other associated external equipment which is separate from the air logic control apparatus for the filler valves.

SUMMARY OF THE INVENTION

The present invention comprises a novel electronic control system for controlling a sequence of operations on any kind of a product moving on an indexing conveyor. For example, the electronic control system of the present invention could be used for sequentially operating data heads, foamer heads on a packaging machine, a filler apparatus on a packaging machine, sealing heads on a packaging machine, and so forth.

The invention is illustrated hereinafter for controlling operations on cartons. However, the product worked on would not necessarily have to be a carton and it can be any kind of a product. As disclosed hereinafter, the electronic control system is illustrated as controlling a filler apparatus of a packaging machine for controlling the filling of cartons, and for controlling the sonic sealing head for sealing the cartons, and for controlling the clean-in-place (C.I.P.) apparatus of the packaging machine for cleaning the filler apparatus.

The electronic control system of the present invention comprises a self-contained control module which includes three printed circuit boards which are directly interfaced with conventional machine wiring, as for example the conventional wiring of a packaging machine. The electronic control system has many advantages over the prior art type air control systems employed heretofore for controlling the various operations in a packaging machine, such as for controlling the carton filling operation. It employs a single sealed limit switch carton detector which is disposed in a position removed from the immediate carton filler discharge area, so that it is less subject to spillage problems encountered by the prior art air control mechanical carton detectors. The limit switch carton detector reduces carton damage because of a reduced force on the cartons which is exerted on the cartons in a reduced contact area as they are moved past the limit switch detector. Furthermore, the cartons are only touched once by the limit switch detector which further reduces the possibility of carton damage.

Another advantage of the electronic control system of the present invention over the prior art air control systems for packaging machines is that it requires fewer mechanical parts. For example, the aforementioned single limit switch detector replaces an entire manifolded air logic assembly, including the individual carton detectors for each filler nozzle, the individual filler controls for the operator, and several electro-mechanical parts for the clean-in-place (C.I.P.) system. When the packaging machine is equipped with an ultrasonic carton top sealing apparatus, the electronic control system is simpler than said prior art air control system, since it includes a limit switch detector and two solenoid valves, but these parts carry out the functions provided in prior art control systems by a relay, a timer, and two limit switches.

A further advantage of the electronic control system of the present invention is that all of the filler nozzles may be used in any type of filling mode. The filler apparatus may be selectively operated for various quantities, that is, quarts, pints, and half-pints, and the selection of a particular filler operation is automatically sequenced in coordination with the presence of cartons at the filler stations.

As disclosed hereinafter, the electronic control system is employed for controlling the filler apparatus, the ultrasonic carton top sealing apparatus, and the filler nozzle clean-in-place (C.I.P.) apparatus. A limit switch carton detector is disposed in an operative position along the carton indexing conveyor, and it senses the cartons in an indexing manner as they go by. As the cartons go by the carton limit switch indicates that the switch is operated, and if a carton is present, that information is loaded into an electronic memory which provides an electronic picture of the indexing conveyor. The electronic memory is provided with a desired number of positions, as for example, the sixteen positions of the illustrated packaging machine. The electronic memory retains the location of a carton on the indexing conveyor as it is moved through the sixteen stations. Each time the machine is moved or indexed, the information in the electronic memory is indexed or advanced in the memory. If there is no carton present at the station sensed by the carton limit switch detector, then that information is also loaded into the memory, and such information is advanced in the memory. A machine cycle timing switch, in the form of a limit switch, is also disposed adjacent the indexing conveyor, or some other moving part of the machine, to indicate when the machine is moved. Accordingly, each time the indexing conveyor moves, that information is also loaded into the memory in index form. When the electronic control circuit gets the information that there is a carton present at a certain position on the indexing conveyor, it will operate the filler valve at that position on the conveyor. If a carton is not present at a particular position on the indexing conveyor when it reaches a filler station, then the valve at that filler station will not operate.

The filler valves in a particular packaging machine may be constructed to discharge a predetermined amount of fluid, as for example, in a four-station filler apparatus, each filler head would give four ounces of milk to provide a maximum of sixteen ounces for filling a container in four steps or movements of the indexing conveyor when the electronic control circuit of the present invention functions to operate the four valves for the four filler heads. In the aforedescribed prior art air control systems, it is mandatory that any selected valve must operate for all cartons. Therefore, if the quantity of fluid dispensed is, for example, only four ounces, then one and only one valve is operated. Such single valve operations cause the other filler contents to stagnate since the fluid is not in continuous circulation. Under the electronic control system of the present invention, all filler head valves operate an equal number of times, so that the contents of the filler valves do not stagnate. All valves operate in unison for every operation. The frequency of occurrence of these operations is determined by the electronic control system as required to dispense the necessary total quantity of fluid into each carton. For example, if the cartons are to be filled with only four ounces, then the packaging machine will index three times without filling any cartons, then on the fourth index all four filler valves operate at the same time delivering four ounces each to their four respective waiting cartons. Thus, the machine will index empty thrice, fill once, empty thrice, fill once, and so forth so that all of the valves are used an equal number of times.

The operation of all valves an equal number of times also has the advantage of equalizing the wear on the valve parts and maintains more consistent calibration of the fillers, whereas under the old air control system, such uniformity of wear and calibration can not be assured.

Additionally, the ability to operate all of the valves during a filling operation is advantageous since it balances out the mechanical load on the packaging machine, whereas under the old air control system, there is an imbalance of mechanical load on the machine.

The electronic control system of the present invention is also adapted to operate the ultrasonic carton top sealer apparatus which is located at one of the sixteen stations on the indexing conveyor of the illustrated packaging machine. The aforedescribed carton information is combined with a timing signal provided by a second limit switch machine timing indicator disposed along the path of the indexing conveyor to provide information to operate the sonic sealer head at the proper time. The filler valves are not operated at precisely the same point in time as when the sonic sealer head is operated, and accordingly, a limit switch machine timing indicator is required to provide a separate time signal for operating the sonic sealer head. The clean-in-place (C.I.P.) operation is also capable of being carried out with the machine mechanism position information provided by a limit switch machine mechanism position indicator which is also positioned along the indexing conveyor to provide a position signal.

The electronic control system of the present invention is advantageous in that the vital parts or core of the system is contained on two printed circuit boards, whereby replacements of such boards in the field is simplified, and may be quickly carried out. Also, down time is reduced because of the quick printed circuit board exhange features. The printed circuit boards employed in the invention are fully capable of controlling various types of filler apparatuses for packaging machines. Coding or programming of the electronic control is accomplished by a single jumper board into which the input and logic printed circuit board, and the driver printed circuit board, are plugged. Accordingly, the input and logic printed circuit board, and the driver printed board are each interchangeable with similar boards, from one machine to another. A further advantage of the invention is that the need for programming the input and logic printed circuit board at the time of instalation is eliminated.

The electronic control system of the present invention is illustrated hereinafter as applied to a typical packaging machine for controlling the operation of the filler apparatus, the ultrasonic sealing apparatus, and the clean-in-place (C.I.P.) apparatus for cleaning the filler heads of the filler apparatus. A first limit switch carton detector is disposed adjacent one of the sixteen stations on the indexing carton conveyor of the packaging machine, and it provides a carton signal to the effect that a carton is or is not present at said one station. A second limit switch is disposed at some suitable place on the machine, to provide a machine timing signal. The carton signal and the machine timing signal are fed into a group of circuits, generally called a shift register, which provides what may be termed an electronic picture of the sixteen stations on the indexing conveyor. The shift register includes sixteen registers, with each register representing one of the carton pockets on the indexing conveyor. The machine timing signal provided by said second limit switch advances the data in the shift register with the indexing of the conveyor. The carton data in the shift register is thus advanced with each index of the conveyor.

The timing signal provided by said second limit switch is also fed into another circuit termed a machine cycle counter. The machine cycle counter counts the indices made by the conveyor and provides an output after a predetermined number of indices, as for example, four indices. The output signal of the machine cycle counter is fed through a selected line, in accordance with a code pattern, into a circuit termed a sequence selector which functions as a selector switch.

The sequence selector determines the required number of fill stations to fill a carton of a predetermined size which has been selected by the operator by operating a selector switch on the operator's console. The operator selects whether he wants to fill quarts, pints, half-pints, and so forth. The sequence selector detects what size the operator has selected, and then based on that size, selects the proper sequence provided at its input terminals, and said proper sequence is provided by the machine cycle counter.

The carton position information from the shift register and the sequence information from the sequence selector are fed into an "and" gate, and if both inputs are true, a filler sequence output results for operating the filler apparatus. That is, if a carton is present at a filler station, and if the sequence indicates that it is time to fill that carton, then the filler valve at that station is operated.

The electronic control of the present invention can also operate the ultrasonic sealer apparatus at the sonic sealer station which is disposed a number of stations down the indexing conveyor from the filler apparatus. The carton position information is fed from the first described shift register into a second shift register which is an electronic picture of the indexing conveyor beyond the filler station. Because of different timing requirements between the filling operation and the sealing operation, said operations do not occur at precisely the same point in time. A second limit switch machine timing indicator is positioned adjacent the conveyor, and the signal generated by this limit switch is a timing signal that is fed into the second shift register. The timing signal created by the last mentioned second limit switch machine timing indicator is necessary because the point in time where the filler valve is started down for an operation is not precisely the same point in time when the sonic sealer head is started down for an operation. There is a slight phase difference in the action of the filler valve and the sonic sealer head. The second shift register feeds an output signal, which is carton position information, into a second "and" gate. The last mentioned carton timing signal is also fed into an overtime timer which produces a signal that is fed into the second "and" gate which functions in the same manner as the first "and" gate. The second "and" gate produces a sonic sequence output signal if both of the input signals are true. The overtime timer functions as a safety means to guarantee that the seal welding process will be completed if the machine should be stopped for any reason, so that the carton being sealed is not wasted. This feature is an advantage because it minimizes carton loss.

A limit switch machine mechanism position indicator is disposed along the indexing conveyor to provide a machine mechanism position information signal which is a position signal and which is fed into a filler apparatus clean-in-place (C.I.P.) sequence timer. The output of the C.I.P. sequence timer is fed into a sequence selector which provides a timing signal that is needed to operate the filler valves during a filler apparatus clean-in-place operation when the machine is not running.

Other features and advantages of this invention will be apparent from the following detailed description, appended claims, and the accompanying drawings.

DESCRIPTION OF THE PREFERRED EMBODIMENT

Figure 1:
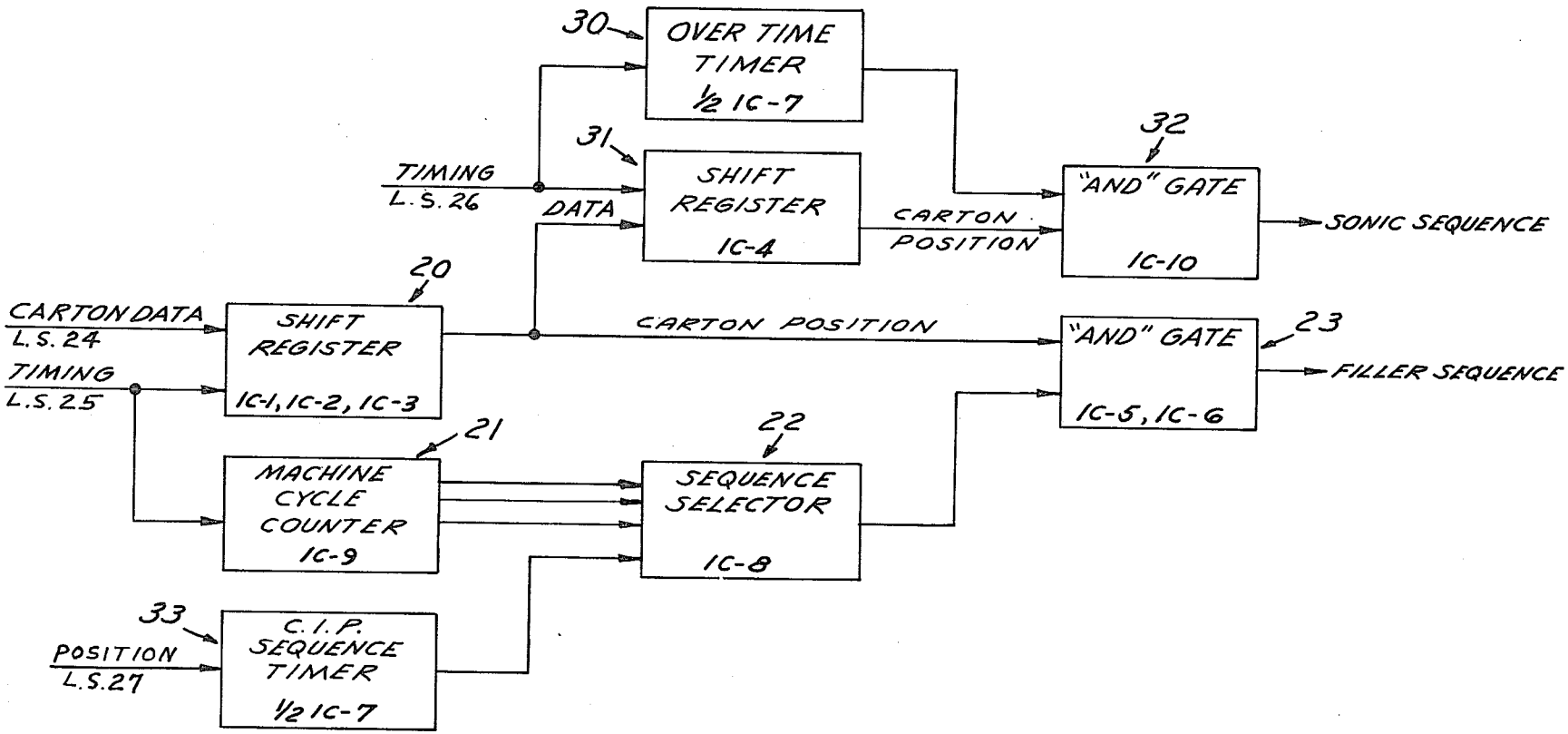
FIG. 1 is a block diagram of an electronic control system embodying the invention as applied for controlling a sequence of operations on containers as they are filled and sealed by a packaging machine.

Referring now to the drawings, FIG. 1 is a block diagram of an illustrative embodiment of the electronic control system of the invention as applied for controlling a sequence of operations on cartons or containers as they are filled and sealed by a packaging machine. Although the invention is illustrated as applied to controlling a sequence of operations by a packaging machine, it will be understood that the invention is also applicable to other types of control operations on other types of machines.

Figure 2:
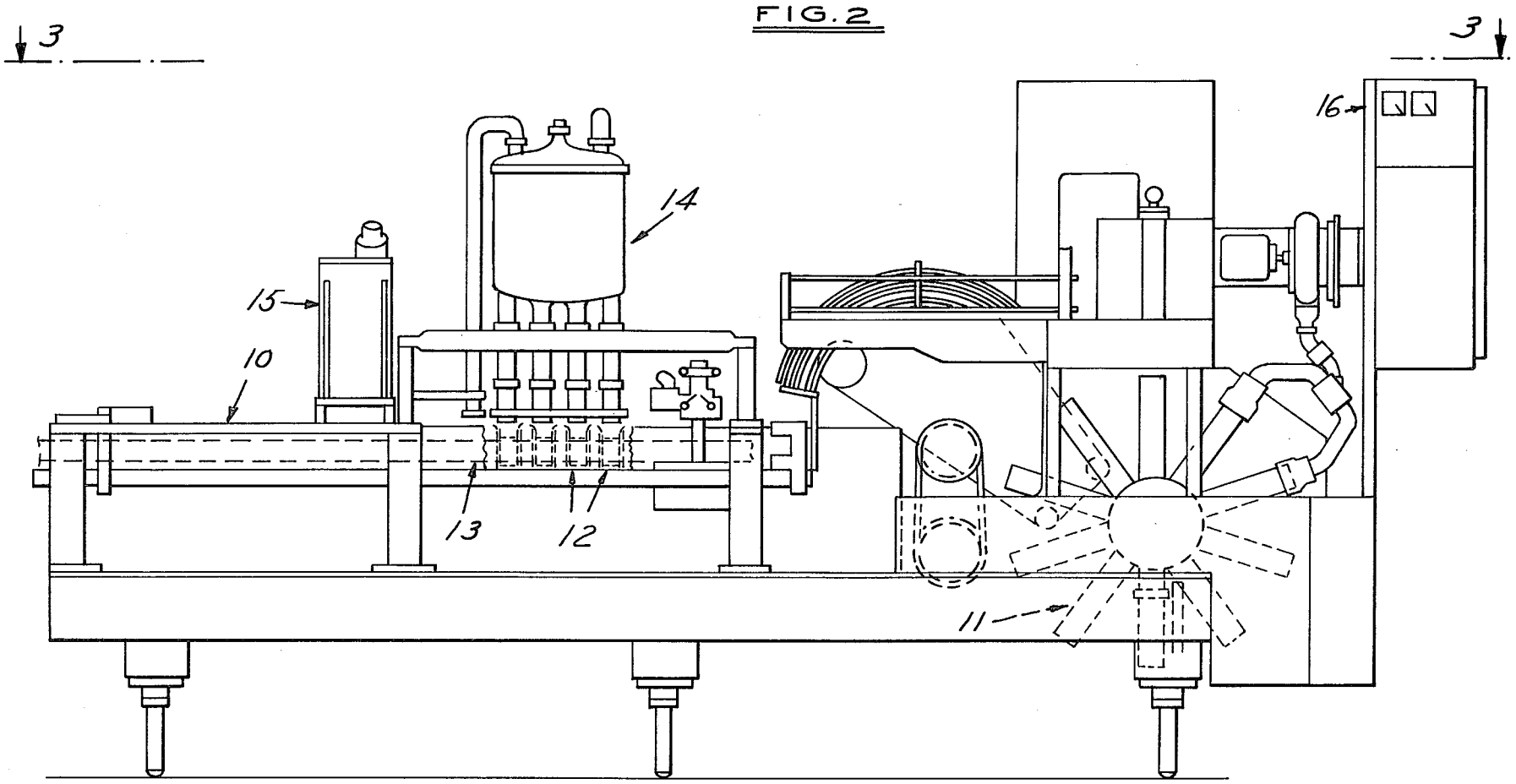
FIG. 2 is a side elevation view of a typical packaging machine on which the electronic filler control of the present invention may be employed.
Figure 3:
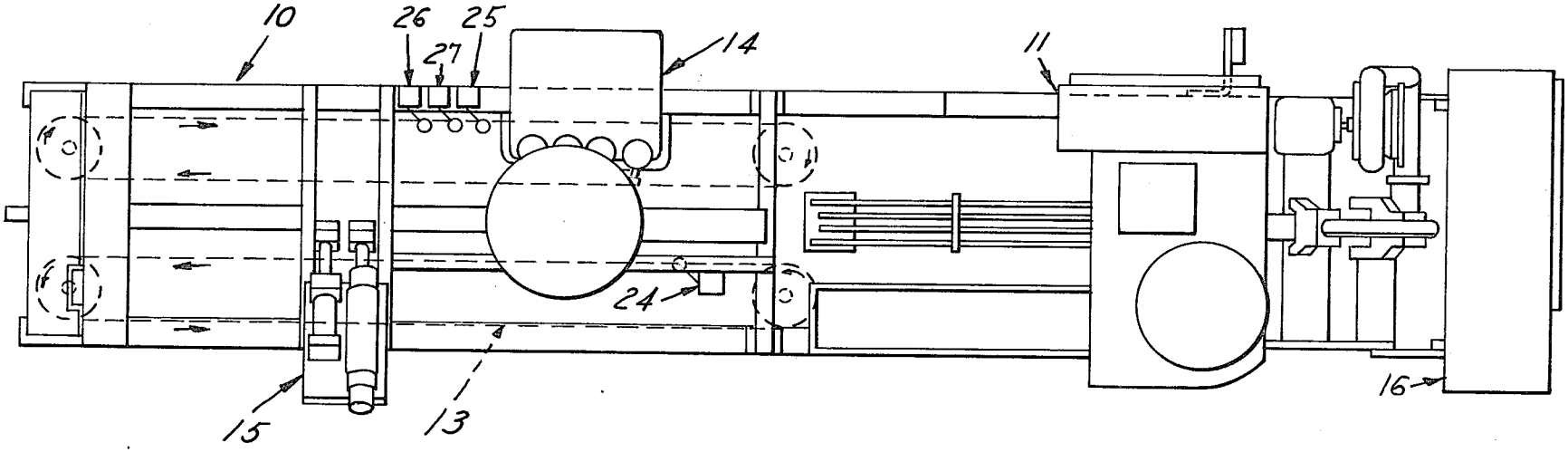
FIG. 3 is a top plan view of the packaging machine structure illustrated in FIG. 2, taken along the line 3—3 thereof, and looking in the direction of the arrows.

FIGS. 2 and 3 illustrate a typical packaging machine, generally indicated by the numeral 10, on which the electronic control system of the present invention may be employed as an electronic carton filler control, carton top end sealer control, and filler head clean-in-place (C.I.P.) control. The numeral 11 in FIGS. 2 and 3 generally designates the portion of the machine 10 which erects and feeds cartons, generally indicated by the numeral 12, to a single line indexing carton conveyor, generally indicated by the numeral 13. The indexing carton conveyor 13 indexes one station at a time, through a plurality of sixteen stations, and the electronic control system is programmed for this number of work stations, although it could be programmed for any desired number of work stations. As shown in FIG. 3, the indexing conveyor 13 is a conventional carton chain conveyor, which has two endless chain members that grip cartons therebetween in carton pockets, and convey the cartons through the various work stations. A carton filler work station is generally indicated by the numeral 14, and it includes four filler heads which have discharge valves that are controlled by the electronic control system of the invention. It will be understood that the invention could be applied to control any number of filler head valves.

Figure 4:
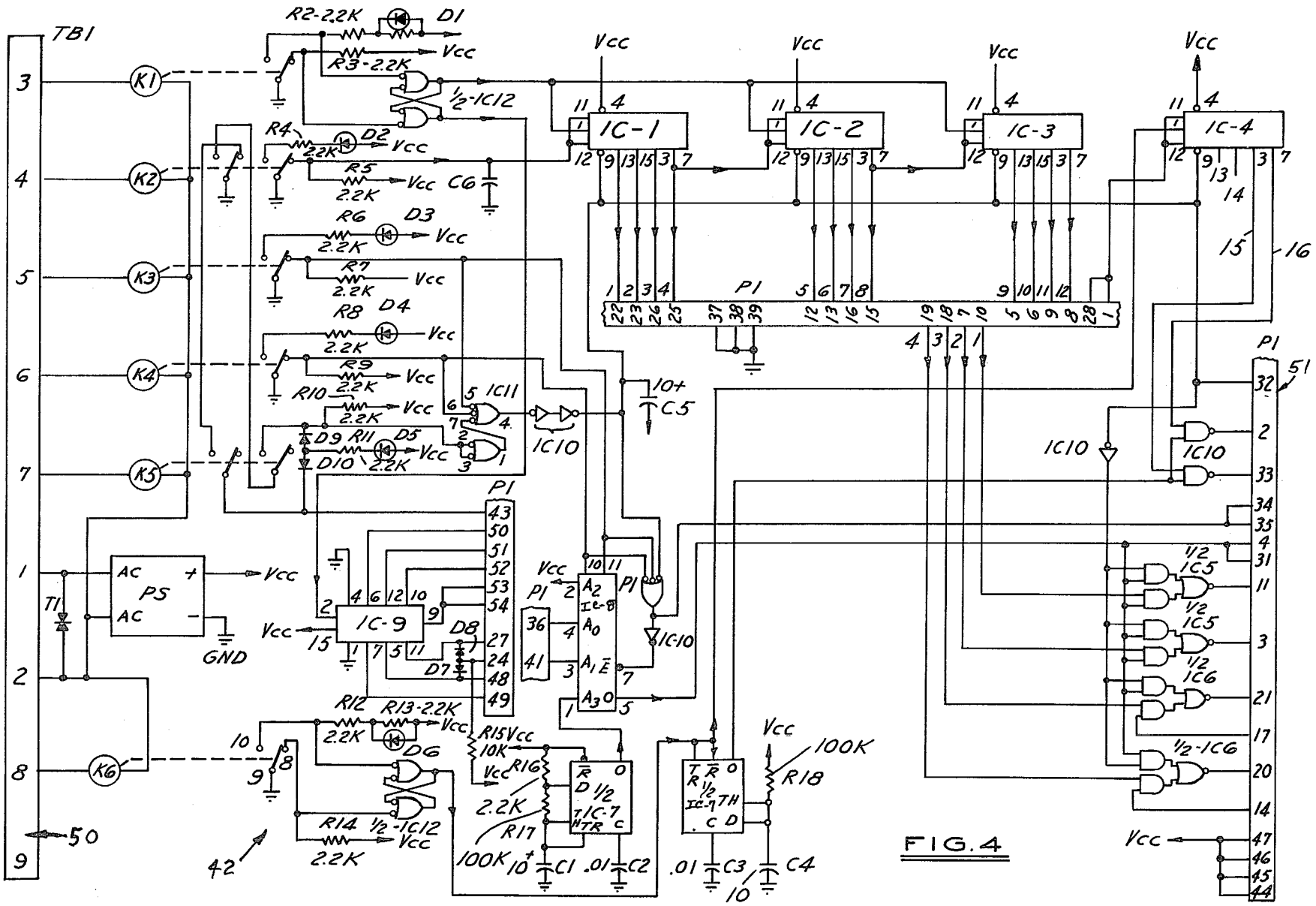
FIG. 4 is an electronic schematic of an input and logic printed circuit board employed in the illustrated embodiment of the invention.
Figure 5:
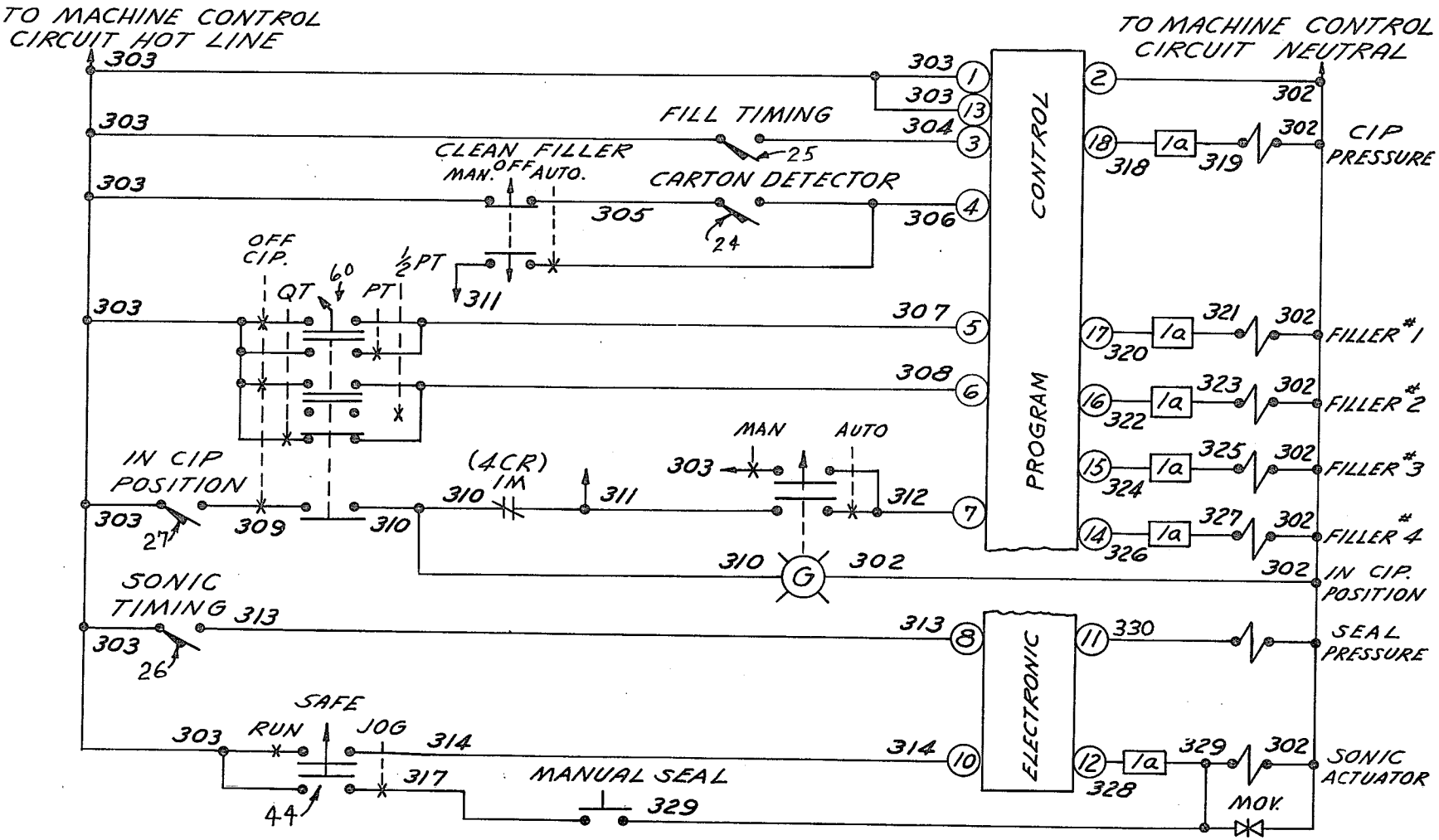
FIG. 5 is an electrical schematic of the electronic control system integrated with a typical machine control circuit.
Figure 6:
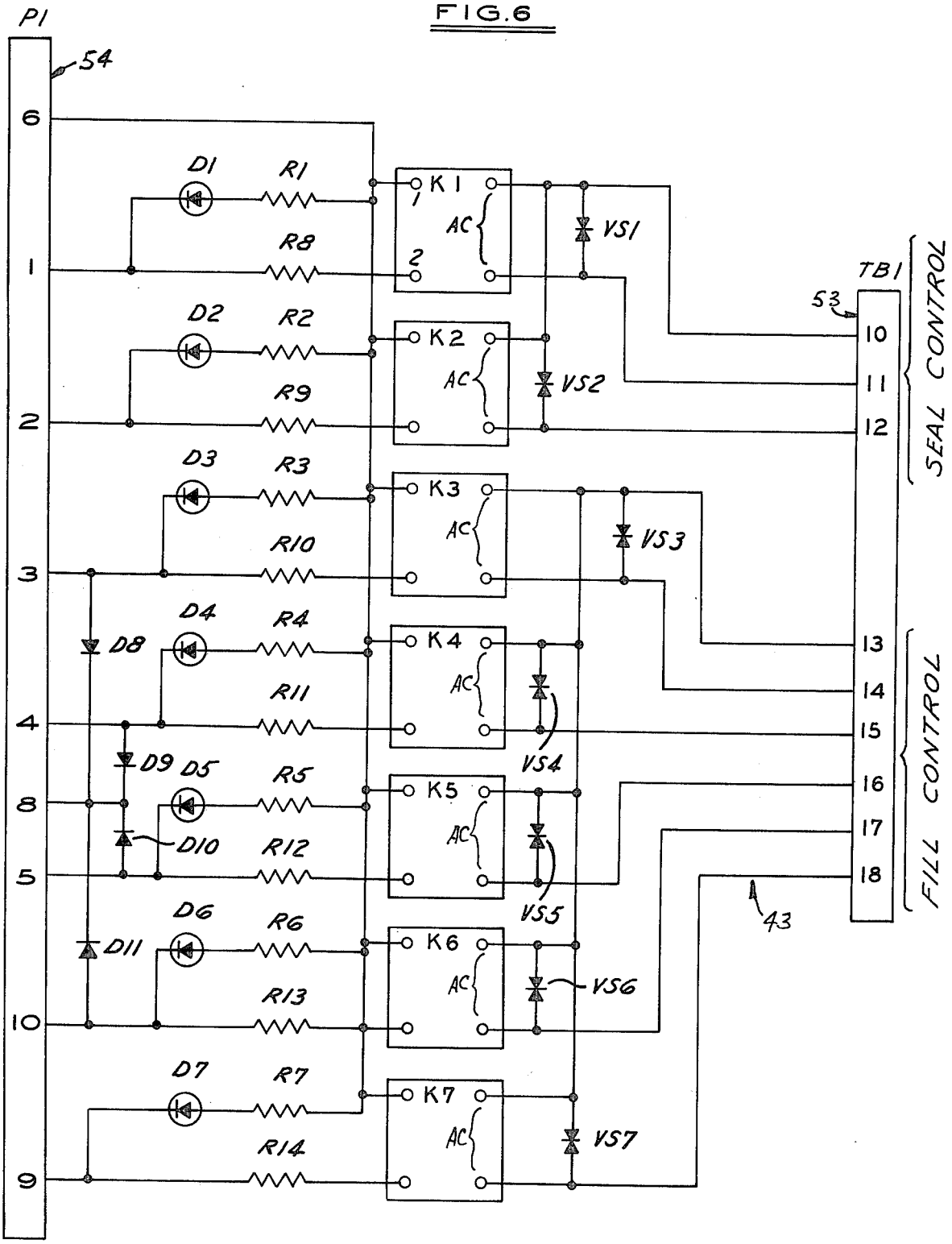
FIG. 6 is an electronic schematic of a working circuit or driver circuit board employed in the illustrated embodiment of the invention.

The numeral 15 generally designates an ultrasonic carton top end sealing apparatus which is disposed a number of work stations beyond the carton filler work station. One typical packaging machine represented by FIGS. 2 and 3 is a Model QM2 packaging machine available on the market from the Ex-Cell-O Corporation of 2855 Coolidge, Troy, Michigan 48084, and which packaging machine is provided with a carton filler apparatus and an ultrasonic sealing apparatus adapted to be controlled by the electronic control system of the present invention. The numeral 16 in FIGS. 2 and 3 generally designates a control console in which the printed circuit boards illustrated in FIGS. 4, 5 and 6 are operatively mounted.

The electronic control system of the present invention is illustrated generally in the block diagram of FIG. 1 for controlling the carton filling operations, the sonic sealing operations, and the filler head clean-in-place operations on the aforementioned Model QM2 packaging machine having a four station carton filler apparatus. As shown in FIG. 3, a carton detector limit switch 24 is disposed along the indexing conveyor path at any desired position, ahead of the filler apparatus 14, as for example, at one conveyor position ahead of the first work station of the filler apparatus 14. The limit switch 24 senses the cartons 12 in an indexing manner as they go by, and if the limit switch 24 is operated then a carton is present at that position, and that carton position information is loaded as a signal into a first shift register, generally indicated by the numeral 20.

The first shift register 20 comprises a plurality of integrated circuits identified as IC-1, IC-2 and IC-3. A second limit switch 25 (FIG. 3) is mounted on the machine 10 at a suitable position to sense machine cycles. As for example, the limit switch 25 is shown in FIG. 3 as being mounted adjacent the moving conveyor 13 to sense the indices of the conveyor 13 which correspond to the machine cycles. However, it will be understood that the stated limit switch 25 could be disposed so as to be operated by revolutions of the drive shaft of the machine 10, or any other desired position, so as to obtain a machine cycle signal.

The machine cycle signal generated by the limit switch 25 is used as timing information to load carton presence information from limit switch 24 into the shift register 20 in serial form. The information loaded into the shift register provides an electronic picture or memory of the indexing conveyor 13. The electronic memory is provided with a desired number of positions, as for example the sixteen positions of the illustrated packaging machine 10. The electronic memory remembers the location of a carton 12 on the indexing conveyor 13 as it is moved through the sixteen stations. Each time the conveyor 13 is indexed, the information in the electronic memory is indexed or advanced in the memory. If there is no carton 12 present at a station sensed by the carton limit switch detector 24, then that information is also loaded into the memory and such information is advanced in the memory. Accordingly, each time the indexing conveyor 13 moves, that information is also loaded into the memory in serial form. When the electronic control circuit gets the information that there is a carton present at a certain position on the indexing conveyor, it will operate the filler valve of the filler apparatus 14 at a position on the conveyor 13. If a carton is not present at a particular position on the indexing conveyor 13 when it reaches a filler station, then the valve at that filler station will not operate.

The machine timing signal provided by the second limit switch 25 advances the data in the shift register 20 with the indexing of the conveyor 13. The carton data in the shift register 20 is thus advanced with each index of the conveyor 13. The timing signal provided by the second limit switch 25 is also fed into another circuit termed a machine cycle counter, generally indicated by the numeral 21, and which comprises an integrated circuit identified as IC-9. The machine cycle counter 21 countes the indices made by the conveyor 13, and produces an output after a predetermined number of indices, as for example four indices. The output signal of the cycle counter 21 is fed through a selected line, in accordance with a code pattern, into a circuit termed a sequence selector, and which includes an integrated circuit identified as IC-8. The sequence selector 22 functions as a selector switch, and it determines the required number of fill stations at the fill apparatus 14 to fill a carton 12 of a predetermined size which has been selected by the operator by operating a selector switch on the operator's console 16. The operator selects whether he wants to fill quarts, pints, half-pints and so forth. The sequence selector detects what size the operator has selected, and then based on that size, selects the proper sequence provided as its input terminals by the machine cycle counter.

As shown in FIG. 1, there are three lines connecting the machine cycle counter 21 to the sequence selector 22, and the sequence selector 22 selects one of these lines in determining the required number of fill stations to be operated for a certain size carton. The sequence selector 22 functions as a four-pole switch, and it determines the number of fill stations required to fill a certain size carton. For example, if each filler station discharges four ounces of fluid, and the selected container is a four-ounce carton, then the sequence selector 22 selects an input signal through a line from the machine cycle counter which gives a count of one of four. If an eight-ounce container is to be filled, then the sequence selector 22 selects an input signal of two of four. If a sixteen-ounce container is to be filled by the filler apparatus 14, then the sequence selector 22 selects an input of four of four. Accordingly, if a carton 12 is present at a fill station, and if the sequence selector 22 determines that the carton 12 at that station should be filled, then the filler valve at the particular filler station where the carton is positioned will operate.

The carton position information from the first shift register 20 and the sequence information from the sequence selector 22 are fed into a first "and" gate 23, and if both inputs are "yes", or "true", a filler sequence output results for operating the selected filler valves of the filler apparatus 14.

The operation of the ultrasonic sealing apparatus 15 by the electronic controls of the present invention, is carried out in the following described manner. The carton position information is fed from the first described shift register 20 into a second shift register, generally indicated by the numeral 31, and which comprises an integrated circuit identified as IC-4. The ultrasonic sealing apparatus 15 is disposed a number of stations down the indexing conveyor 13 from the fill apparatus 14, and the second shift register 31 provides an electronic picture or memory of the indexing conveyor 13 beyond the filler apparatus 14. Because of timing requirements between the filling operation and the sealing operation, said operations do not occur precisely the same point in time. Accordingly, a third limit switch 26 (FIG. 3) is positioned adjacent the conveyor 13, and a timing signal is generated which is fed into the second shift register 31. The second shift register 31 comprises an integrated circuit identified as IC-4. The timing signal created by the limit switch 26 is necessary because the point in time when the respective filler valve is started down for a filling operation, is not precisely the same point in time the sonic sealing head of the sealing apparatus 15 is started down for an operation. There is a slight phase difference in the action of the filler valve and the sonic sealer head. The second shift register 31 feeds an output signal, which is carton position information, into a second "and" gate, generally indicated by the numeral 32 and which includes an integrated circuit identified as IC-10. The last mentioned carton timing signal is also fed into an overtime timer, generally indicated by the numeral 30, which produces a signal that is fed into the second "and" gate 32. The overtime timer 30 functions as a safety means to guarantee that the seal welding process will be completed if the machine 10 should be stopped for any reason, so that the carton 12 being sealed is not wasted. The overtime timer comprises an integrated circuit identified as one-half IC-7. The second "and" gate 32 produces a sonic sequence output signal if both of the input signals of the overtime timer 30 and the second shift register 31, are "yes", or "true".

As shown in FIG. 3, a fourth limit switch carton detector 27 is positioned along the indexing conveyor 13 to provide a machine mechanism position information signal, which is a position signal, and which is fed into a filler apparatus clean-in-place (C.I.P.) sequence timer, generally indicated by the numeral 33 in FIG. 1. The C.I.P. sequence timer 33 comprises an integrated circuit identified as ½IC-7. The output of the C.I.P. sequence timer 33 is fed into the sequence selector 22 which provides a timing signal that is fed into the "and" gate 23 to operate the filler valves when the machine is not running to carry out a clean-in-place operation.

Figure 7:
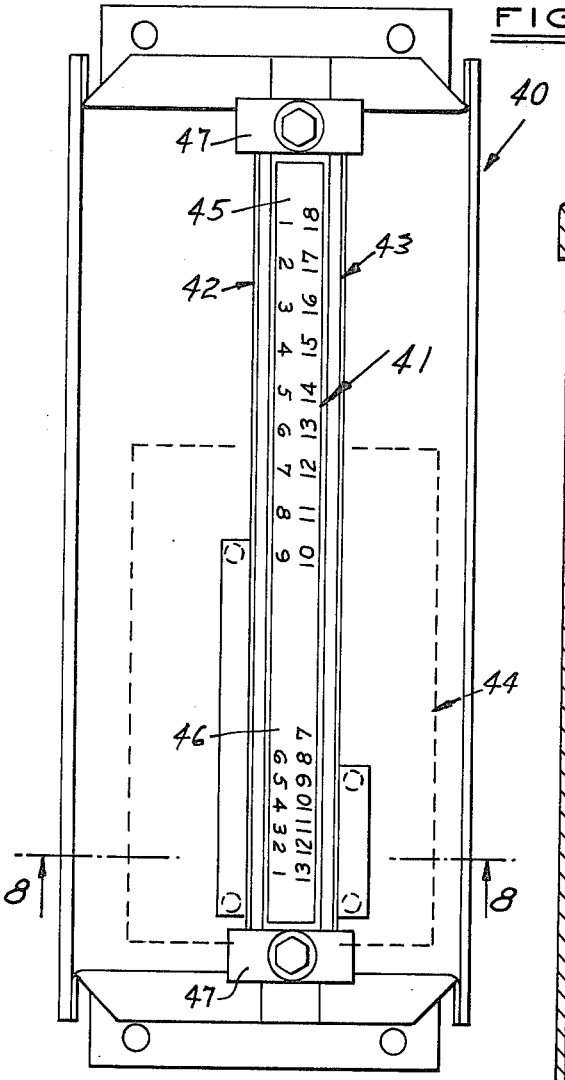
FIG. 7 is a front elevation view of a typical rack which may be employed for holding the printed circuit boards employed in the invention.
Figure 14:
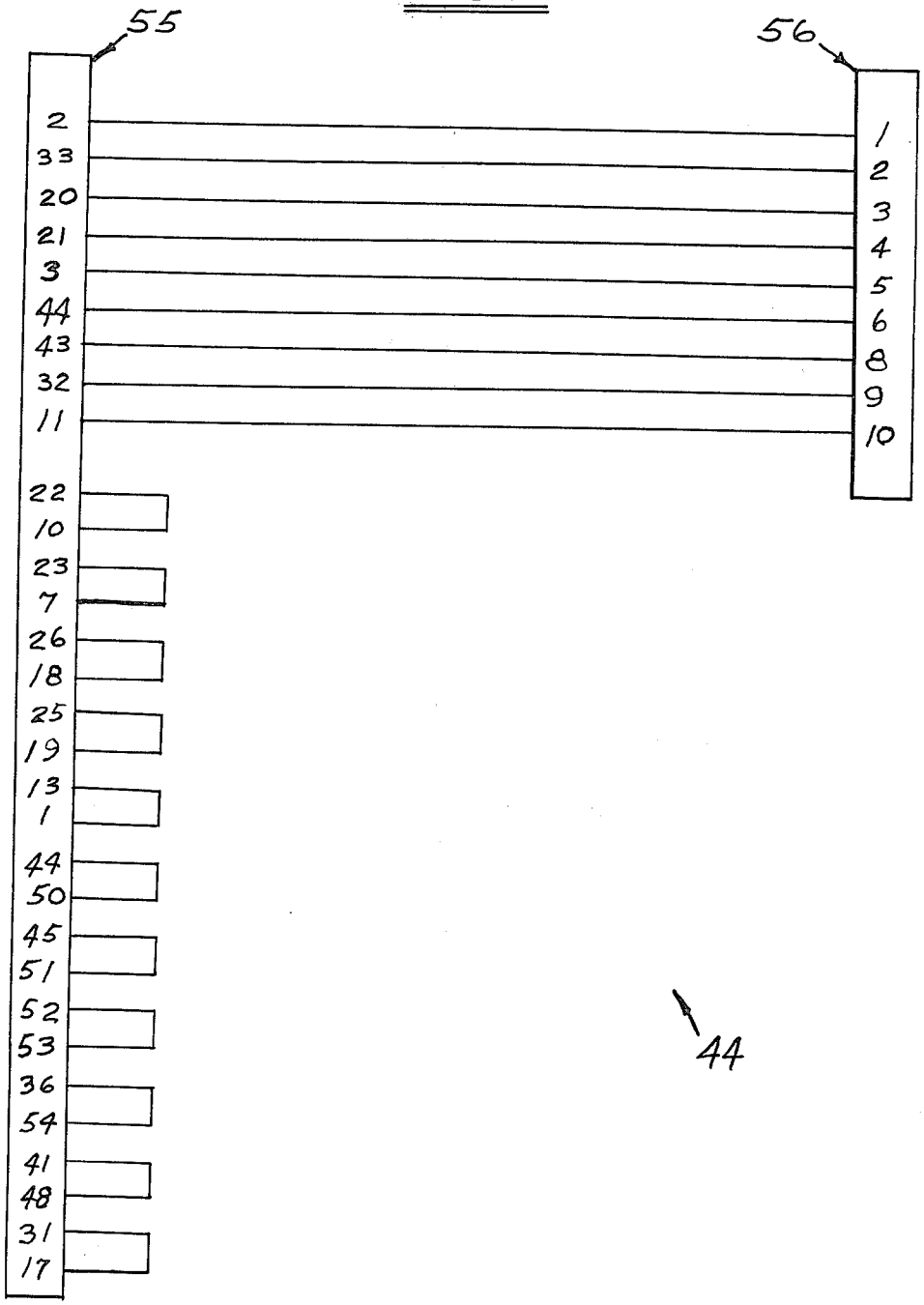
FIG. 14 is an electronic schematic of a typical printed circuit jumper board employed in the illustrated embodiment of the invention.

The various circuits comprising the electronic control system illustrated in FIG. 1 are shown in detail in the printed four circuits of FIGS. 4, 5, 6 and 14. FIG. 4 represents an input and logic printed circuit board, which is indicated in FIG. 7 by the general numeral 42. FIG. 14 comprises a printed circuit jumper board which is represented in FIG. 7 by the numeral 44. FIG. 6 comprises a driver printed circuit board represented by the numeral 43 in FIG. 7. FIG. 5 illustrates the integration of the last aforementioned three printed circuit boards into typical machine wiring circuit. As shown in FIG. 7, the printed circuit boards 42, 43 and 44 are held in an operative position in a suitable rack, generally indicated by the numeral 40. The numeral 41 generally designates a legend plate which includes terminal indicia at one end of the panel indicated by the numeral 45 and indicator light indicia indicated by the numeral 46 at the other end of the panel. Numerals 47 designate conventional printed circuit board retainer members. It will be understood that the printed circuit board rack structure 40 is conventional structure and any suitable structure of this type may be employed.

Figure 8:
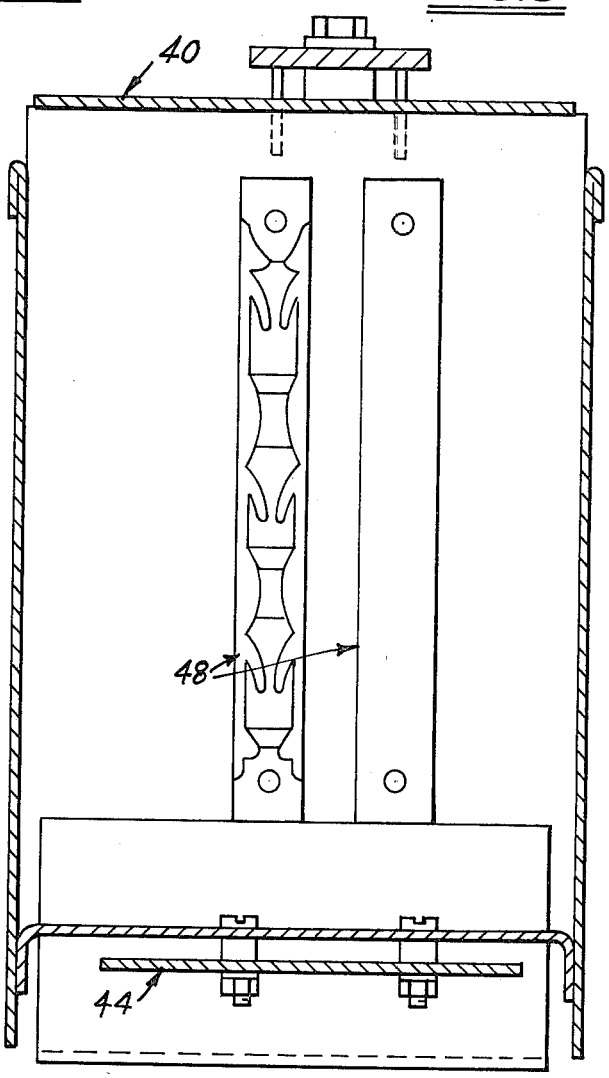
FIG. 8 is a horizontal section view of the printed board rack structure illustrated in FIG. 6, taken along the line 8—8 thereof, and with the logic and driver printed circuit boards removed.

FIG. 8 shows the rack 40 with the printed circuit boards 42 and 43 removed, and showing a pair of card guides, generally indicated by the numeral 48. Suitable printed circuit board structure and supporting rack structures may be obtained from any suitable manufacturer, as for example, from Signals & Systems Inc. of Troy, Michigan.

Figure 10:
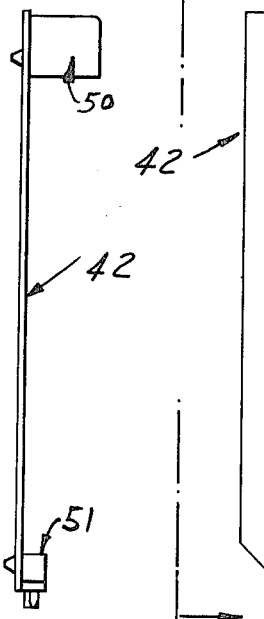
FIG. 10 is a left side elevation view of the printed circuit board illustrated in FIG. 9, taken along the line 10—10 thereof, and looking in the direction of the arrows.
Figure 9:
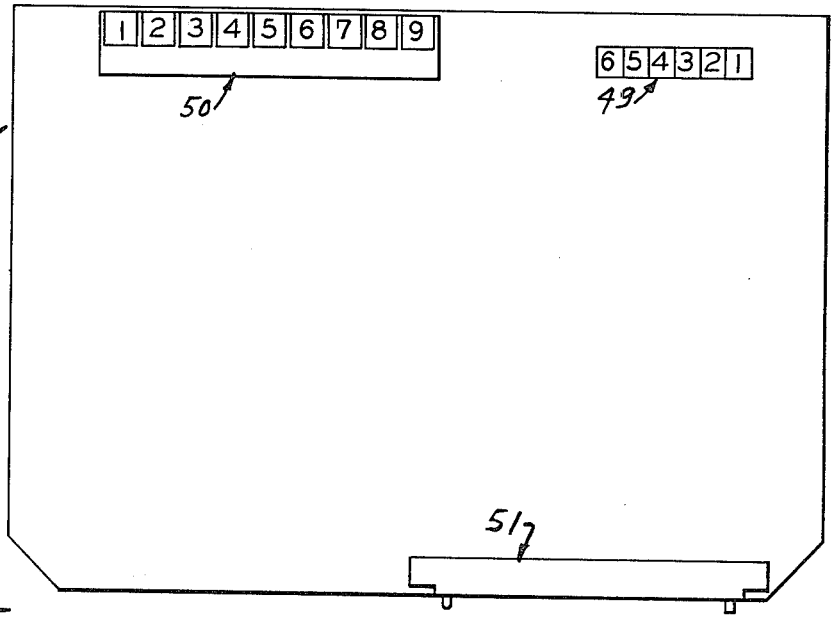
FIG. 9 is a front elevation view of an input and logic printed circuit board employed in the invention.

FIGS. 9 and 10 generally indicate the input and logic printed circuit board 42 which includes six light emitting diodes, generally indicated by the numerals 49. Suitable light emitting diodes may be obtained from the Dialight Corporation of 230 Harrison Place, Brooklyn, New York 11237, and they are identified as Model 550-0103. A terminal strip, generally indicated by the numeral 50, is mounted along the top of the printed circuit board 42. Any suitable terminal strip 50 may be employed, and a suitable one is available from Reed Devices of 21 West 185 Hill Avenue, Glen Ellyn, Illinois 60137, and identified as Model No. 6 PCR09. Terminal strip 50 is also identified in FIG. 4 as terminal strip TB1. The numeral 51 in FIG. 9 generally designates a printed circuit board connector which may be of any suitable type, as for example a connector availble from the Air Borne Controls, Inc. of 9939 Glen Oaks Street, Sun Valley, California under Model No. WTB54PR7SY. The components of FIG. 4 are mounted in the central area of the board between the lights 49, the terminal strip 50 and the connector 51.

Figure 11:
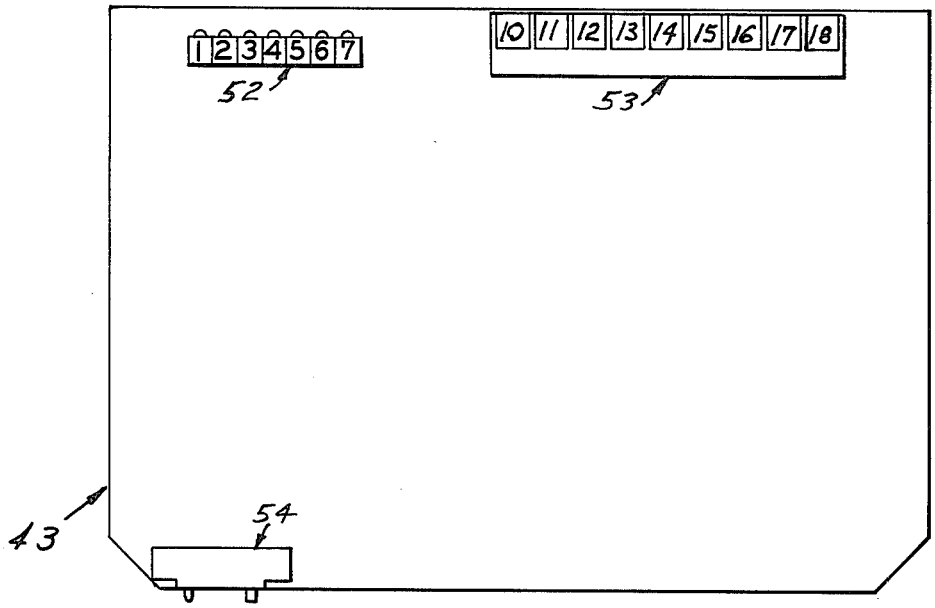
FIG. 11 is a front elevation view of a seven output driver printed circuit board employed in the invention.

The numeral 43 in FIG. 11 illustrates the driver board circuitry of FIG. 6, and it includes light emitting diodes, generally indicated by the numeral 52, and a terminal strip 53, which are the same as the diodes and terminal strip of FIG. 9. The numeral 54 generally indicates a suitable printed circuit board connector which is also obtainable from said Air Borne Controls Inc. under Model No. WTB10PR7SY. The printed circuit board connectors 51 and 54 are identified in FIGS. 4 and 6 by the symbols P1. The components of the driver board are located in the central area of the board 43.

Figure 12:
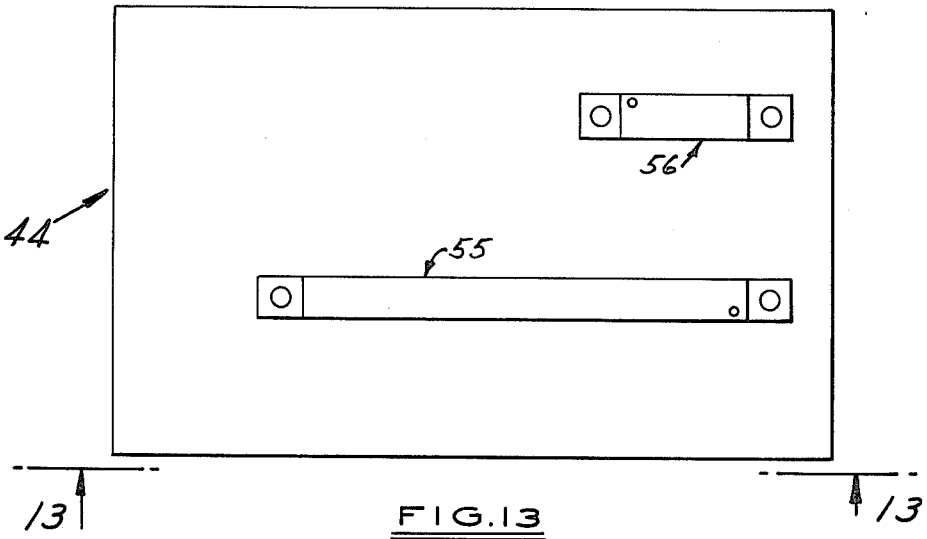
FIG. 12 is a front elevation of a jumper printed circuit board employed in the invention.
Figure 13:
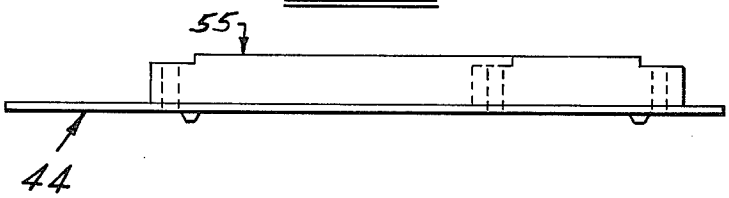
FIG. 13 is a bottom view of the jumper printed circuit board illustrated in FIG. 12, taken along the line 13—13 thereof, and looking in the direction of the arrows.

The numeral 44 in FIG. 12 contains the jumper board circuitry of FIG. 14. The numerals 55 and 56 generally designate conventional socket connectors for connecting the various circuits together. Suitable connectors 55 and 56 are obtainable from the aforementioned Air Borne Controls, Inc. under Model Nos. WTB54SED9SY and WTB10SED9SY, respectively.

FIG. 4 is a schematic of the input and logic printed circuit board 42. An AC input to the circuitry of FIG. 4 is connected to terminals 1 and 2 of terminal strip 50 or TB1. A 15-volt DC power supply, indicated by the letters PS in FIG. 4, is connected to terminals 1 and 2. Any suitable DC power supply may be employed, as for example, a DC power supply available on the market from the Acopian Corp., of 132 Loomis Street, Easton, Pa. 18042, under Model 15E40. Carton position limit switch 24 is connected to terminal 4 of terminal strip 50 (TB1). Machine timing limit switch 25 is connected to terminal 3 of terminal strip 50.

The timing signal from limit switch 25 operates relay K1 which provides 120 volt AC from the machine wiring to provide 120 volts AC on the relay coil. When limit switch 25 is closed, relay K1 is operated and when the limit switch 25 is released, relay K1 is de-energized. The timing signal from limit switch 25 is fed through a conventional de-bouncing circuit and into the integrated circuits of shift register 20 which are identified as integrated circuits IC-1, IC-2, and IC-3. The last mentioned timing signal is the signal that causes the shift register 20 to move all of its data with each machine or conveyor movement or indexing.

The carton position signal from limit switch 24 also is fed into the integrate circuits IC-1, IC-2 and IC-3. Each one of the 16 positions of the conveyor 13 is shown as outlets of the integrated circuits IC-1, IC-2, IC-3 and IC-4. They are indicated by the numerals 1 through 16. A timing signal from limit switch 25 also goes down into an integrated circuit identified as IC-9 which comprises the machine cycle counter 21. The machine cycle counter 21 can be programmed in many different ways, and is provided with many outputs and inputs shown in FIG. 4 which are brought out to the various pins on the connector board P1.

The machine cycle counter 21 can be programmed in any manner that is required for the machine to which the electronic control system is being connected. The section of FIG. 4 around IC-9 can be termed "the counter program", and the various lines connected thereto may be termed counter program ports. Based upon combinations of applied voltage, or ground signals, any desired counting program may be obtained out of the counter 21 in accordance with information published by the manufacturer of that integrated circuit IC-9. The jumper board 44 gives the proper interconnections to program the integrated circuit IC-9. A suitable IC-9 integrated circuit is one available on the market from the Teledyne Company of 1901 Avenue of the Stars, Los Angeles, California, 90067, under Model No. 372AL.

The code for selecting which one of the inputs of IC-8 is to be employed for the size carton to be filled, is set up when the operator operates the selector switch, generally indicated by the numeral 60 in FIG. 5. The code set up by the selector switch 60 is set up on terminals 5 and 6 of terminal strip 50.

The output from the circuits of the shift register 20 and the sequence selector 22 (IC-8) are fed to the two integrated circuits ½ IC-5, and the two integrated circuits ½ IC-6, which are connected to the socket pins indicated by the numerals 11, 3, 21 and 20 of the connector 51 for operating the filler valves #1, #2, #3 and #4, respectively, of the four filler heads of the filler apparatus 14.

The carton position limit switch 24 may be located in another position other than the station next to the filler station. It is a matter of telling the electronics where the switch 24 is located, and how many stations away from the filler apparatus 14 is the ultrasonic sealing apparatus 15. All the last mentioned information is programmed with the jumper board 44 shown in FIG. 14.

The location of the filler apparatus 14 and the valves thereof are programmed by interconnecting the outputs of the shift registers IC-1, IC-2 and IC-3 to the inputs of integrated circuits IC-5 and IC-6. The jumper board 44, through pin type connectors of the type illustrated in FIG. 12, as 55 and 56, connects the various pins on the connector board 51, which is also designated as P1, for example, in the following manner. Pin 45 is connected to pin 51, pin 44 is connected to pin 50, pin 52 is connected to pin 53, pin 36 is connected to pin 54, and pin 41 is connected to pin 48. The last mentioned connections program the integrated circuit IC-9 for the machine cycle counter 21. The jumper board 44 also connects pin 22 to pin 10, pin 23 to pin 7, pin 26 to pin 18, and pin 25 to pin 19, which programs the position of the filler apparatus 14 relative to the carton detector 24. The programming of the other portions of the circuitry of FIG. 4 is accomplished by the jumper board cconnecting pin 13 to pin 1, and pin 31 to pin 17. It will be understood that the jumper board may be constructed so as to interconnect the aforementioned pins and/or pins other pins in different combinations to program the circuitry for other machine configurations and requirements.

The timing signal of limit switch 26 is fed into terminal 8 of terminal strip 50, and into relay K6. As shown in FIG. 4, the last mentioned timing information or signal is fed into integrated circuit IC-4, of the second shift register 31, and into one-half of integrated circuit IC-7. The signal goes through a de-bouncing circuit which is the same sort of circuitry as employed in the circuit of the first timing signal that entered terminal 3. The integrated circuit ½ IC-7 functions to monitor the last mentioned timing signal to make sure that it does not exceed the prescribed length of seal time, and the only time that it will exceed that prescribed seal time is if the machine stops. Under such circumstances, circuit ½ IC-7 functions as a safety mechanism to insure that the sealing welding operation is carried out so as not to damage the carton being sealed if the machine stops.

The outputs of the integrated circuit ½ IC-7 of the overtimer 30 and the integrated circuit IC-4 of the shift register 31 are fed into the integrated circuit IC-10 of the second "and" gate 32, which produces a sonic sequence output at the pins 2 and 33 of the connector 51. The outputs at the pins on the connector 51 are all at a low DC voltage and this voltage must be converted back to 120 volt AC in order to energize the solenoids of the various devices to be operated.

The timing signal of limit switch 27 for the C.I.P. sequence is fed into the input and logic circuit 42 at terminal 7 and into the other integrated circuit ½ IC-7, and thence into the integrated circuit IC-8 of the sequence selector 22.

Suitable integrated ccircuits 1 through 12, as shown in FIG. 4, may be obtained through the aforesaid Teledyne Corporation, under the following model numbers, IC-1 through IC-4—Model No. 375AL; IC-5 and IC-6—Model No. 341 AL; IC-7—Model No. 556 CL; IC-8—Model No. 351AL; IC-9—Model No. 372AL; IC-10—Model No. 333AL; and IC-11 and IC-12—Model No. 326 AL. The relays K-1 through 6 are double pole, double throw relays, and any suitable relay of this type may be employed. Suitable resistor for carrying out the function of resistors R1 through R14 and R16 is a conventional 2.2 K OHM, ¼ W resistor. A suitable resistor R15 is 10 K OHM, ¼ W resistor. A suitable resistor for R17 and R18 is a 100 K OHM, ¼ W resistor. Suitable light emitting diodes D1 through 6 are available from the aforecited Dialight Corporation under Model No. 550-0103. Suitable diodes D7 through D10 are available from various semiconductor manufacturers under the generic type No. 1N4148. Capacitors C1, 4 and 5 have a value of 10 uf, and capacitors C2, 3 and 6 have a value of 0.01 uf.

FIG. 6 shows a seven output driver board 43 which includes seven relays K1 through K7. The low voltage signals generated by the logic circuit 42 of FIG. 4 operate these relays and transform them to line voltage signals at the terminal strip 53 in FIG. 6 for useful work. The output pins of connector 51 on the logic board 42 are connected by the jumper board 44 to the pins on the connector 54 of the circuit of FIG. 6. That is, the terminal 11 of FIG. 4 for filler valve 11 is connected to terminal 10 in FIG. 6. Terminal 3 of connector 51 of FIG. 4 is connected to terminal 5 of FIG. 6 for operating the #2 valve of the filler. Terminal 21 of FIG. 4 is connected to terminal 4 in FIG. 6 to operate the #3 valve of the filler apparatus. Terminal 20 of FIG. 4 is connected to terminal 3 in FIG. 6 to operate the #4 valve of the filler apparatus.

The sonic sequence signal from the second "and" gate 32 is connected from pin 33 in FIG. 4 to pin 2 in FIG. 6, and from pin 2 in FIG. 4 to pin 1 in FIG. 6. Pin 44 in FIG. 4 is connected to pin 6 in FIG. 6; pin 43 of FIG. 4 is connected to pin 9 of FIG. 6. As shown in FIG. 6, the relays K1 through K7 function to transform the low voltage DC logic signals into useful AC line voltage on the right side of the circuit of FIG. 6, which are connected to the terminals 10, 11 and 12 on the terminal strip 53 for the seal control operations, and to the terminals 13 through 18 for the fill control and C.I.P. operations. The terminals 10 through 18 are the same terminals shown in FIG. 5 for operating the various air control valves for the fillers 1 through 4, the air valve for C.I.P. operation, and the air valves which operate the sonic sealing means 15. Suitable relays K1 through K7 are available from said Teledyne Corp. under Model No. 601-1403P. Suitable diodes D1 through D7 are available from said Dialight Corp. under Model No. 550-0103. Suitable diodes D8 through D11 are available from various semiconductor manufacturers under generic type No. 1N4148. Suitable noise suppressors VS1 through VS7 are available from the General Electric Co. of Schenectady, New York, under Model No. V130LA10. FIG. 5 illustrates the integration of the electronic filler control system of the present invention with the general machine control circuitry of the packaging machine 10.

What is claimed is:

1. In an electronic control system for controlling a sequence of operations at work stations on a machine, on products moving on an indexing conveyor having a plurality of product positions, the combination comprising:

(a) a first shift register means;

(b) a conveyor cycle counter means;

(c) a product detector means for sensing the presence or absence of a product on a conveyor at a predetermined position and producing a corresponding product position signal that is fed into said first shift register means;

(d) a first conveyor timing detector means for producing a first timing signal that is fed into said first shift register means and conveyor cycle counter means;

(e) a sequence selector means that selects a sequence signal from the the conveyor cycle counter means; and, (f) a first "and" gate means for receiving input product position information from said first shift register and input sequence information from the sequence selector, and to produce an output signal to control one operation on a product at a first selected work station.

2. The electronic control system as defined in claim 1, including:

(a) a second conveyor timing detector means for producing a second timing signal that is out of phase with said first timing signal;

(b) a second shift register means into which is fed the product position signal from said first shift register means and said second timing signal; and, (c) a second "and" gate for receiving input product position information from said second shift register means and to produce an output signal to control another operation on a product at a second selected work station.

3. The electronic control system as defined in claim 2, including:

(a) an over time timer means for receiving said second timing signal and feeding a time delay output signal to said second "and" gate.

4. The electronic control system as defined in any one of claims 1, 2 or 3 wherein:

(a) said products are cartons and said machine is a carton packaging machine having an indexing conveyor for moving cartons through a plurality of work stations including a carton filler work station and a carton top sealing work station.

5. The electronic control system as defined in claim 4, wherein:

(a) said one operation on a product at a first selected work station comprises a carton filling operation.

6. The electronic control system as defined in claim 5, wherein:

(a) said another operation on a product at a second selected work station comprises a carton top sealing operation.

7. The electronic control system as defined in claim 6, wherein:

(a) said carton top sealing operation comprises an ultrasonic sealing operation.

8. The electronic control system as defined in claim 7, wherein:

(a) said over time timer functions to maintain operation of said ultrasonic sealing operation for a predetermined length of time to insure completion of the sealing operation if the machine stops during the sealing operation.

9. The electronic control system as defined in claim 3, wherein:

(a) said first and second shift register means, said conveyor cycle counter means, said sequence selector means, and first and second "and" gate means are arranged on an input and logic printed circuit board.

10. The electronic control system as defined in claim 9, including:

(a) a driver printed circuit board for converting the control signals produced by the input and logic printed circuit board from DC voltages to AC working voltages; and, (b) a jumper board for operatively interconnecting certain terminals on the input and logic board to certain terminals on the driver board.

* * * * *